US005281280A

United States Patent [19]

Lisowski et al.

[11] Patent Number: 5,281,280

[45] Date of Patent: Jan. 25, 1994

[54] COMPOSITION FOR REMOVING MILDEW CONTAINING HYPOCHLORITE, BICARBONATE AND D-LIMONENE

[76] Inventors: Michael J. Lisowski, P.O. Box 269, Rte. 22, Amenia, N.Y. 12501; Ronald D. Jones, 45 Sharon Rd., Lakeville, Conn. 06039

[21] Appl. No.: 23,616

[22] Filed: Feb. 26, 1993

[51] Int. Cl.[5] ..... C11D 7/12; C11D 7/50; C11D 7/54; C11D 17/08

[52] U.S. Cl. ..... 134/26; 134/42; 252/95; 252/104; 252/173; 252/174.14; 252/DIG. 14

[58] Field of Search ..... 252/95, 104, 173, 174.14, 252/DIG. 14, 106; 134/26, 42

[56] References Cited

U.S. PATENT DOCUMENTS

| | | | |
|---|---|---|---|
| 3,928,608 | 12/1975 | Cox | 424/250 |
| 4,001,227 | 1/1977 | Dreikorn | 424/246 |
| 4,121,902 | 10/1978 | Guise | 8/128 |
| 4,287,080 | 9/1981 | Siklosi | 252/104 |
| 4,339,235 | 7/1982 | Anderson | 8/108 A |
| 4,507,424 | 3/1985 | Webster | 524/442 |
| 4,533,487 | 8/1985 | Jones | 252/170 |
| 4,540,505 | 9/1985 | Frazier | 252/106 |
| 4,614,606 | 9/1986 | Machin | 252/116 |
| 4,664,836 | 5/1987 | Taylor | 252/91 |
| 4,767,563 | 8/1988 | Buzzaccarini | 252/174.25 |
| 4,788,005 | 11/1988 | Castro | 252/539 |
| 4,797,231 | 1/1989 | Schumann | 252/547 |
| 4,889,654 | 12/1989 | Mason | 252/100 |

*Primary Examiner*—Dennis Albrecht

[57] ABSTRACT

A composition for removing mildew is provided in composition comprising an aqueous solution of, by weight, about 2.75–4% sodium hypochlorite, about 0.5-1% sodium bicarbonate and about 0.5–5% d-limonene. The composition is particularly effective in removing mildew, mold and algae from variety of household surfaces, such as wood, metal, ceramic and plastic without damaging the surfaces. The composition is applied to the surface, usually by spraying, and allowed to react with the mildew. After a few seconds, the mildew is easily removed by rinsing with water. Furthermore, this particular combination has additional advantages in that it can also act simultaneously as a degreaser, while giving off a pleasant citrus-like aroma.

4 Claims, No Drawings

COMPOSITION FOR REMOVING MILDEW CONTAINING HYPOCHLORITE, BICARBONATE AND D-LIMONENE

BACKGROUND OF THE INVENTION

This invention relates to a composition which is effective in removing microorganisms from surfaces. More particularly, this invention relates to a composition comprising an aqueous solution of sodium hypochlorite, sodium bicarbonate and d-limonene which is effective in removing mildew, mold and algae from various types of surfaces without harming the surfaces. The term mildew will be used hereinafter to refer generally to undesirable microorganisms which grow on surfaces, including mold and algae.

Numerous compositions containing hypochlorite and bicarbonate are known for treating a surface so as to prevent or remove unwanted biological material.

U.S. Pat. No. 4,664,836 to Taylor, Jr. et al. discloses a crystallized drain cleaner which contains 40-90% of a coated alkali metal hydroxide, 5-20% of a mixture containing a peroxide generator and a hypochlorite generator, 5-20% of a blend of 60% sodium bicarbonate and 40% citric acid. The dry product is added to water before use.

U.S. Pat. No. 4,889,654 to Mason et al. discloses an aqueous foam disinfectant which generates chlorine dioxide. An aqueous solution containing a foam generating agent and a metal chlorite (1-20%) is reacted with an acid solution which may contain sodium bicarbonate (1-50%), and a solution which may contain sodium hypochlorite (1-40%). The resulting solution is then diluted in water.

U.S. Pat. No. 4,507,424 to Webster discloses a composition for restoring grout having sodium carbonate and/or sodium bicarbonate (5-35%), sodium hypochlorite (1-15%), and a de-greasing surfactant (0.5-10%), as well as a resin, thickener, pigment and zinc oxide. The preferred composition is equal parts of carbonate, bicarbonate and hypochlorite, i.e. total of carbonate and bicarbonate at twice the amount of hypochlorite.

The above compositions all involve a long list of additional ingredients, resulting in a costly, complex, and possibly hazardous product which may not be suitable for use on a variety of surfaces found within and on a household.

It is therefore an object of the present invention to provide a composition for removing mildew which is suitable for household use.

It is a further object of the present invention to provide a composition which is characterized by economy and simplicity of manufacture and ease of use.

It is a still further object of the present invention to provide a composition which works immediately on contact to remove mildew from a variety of surfaces without damaging the surfaces, while also giving off a pleasant odor.

SUMMARY OF THE INVENTION

Accordingly, there is provided a composition comprising an aqueous solution of, by weight, about 2.75-4% sodium hypochlorite, about 0.5-2% sodium bicarbonate and about 0.5-5% d-limonene. A more preferred composition comprises about 3.25-4% sodium hypochlorite, about 0.5-1% sodium bicarbonate and about 0.5-1% d-limonene, with the most preferred composition comprising about 3.95% sodium hypochlorite, about 0.5% sodium bicarbonate and about 0.5% d-limonene. An alternative embodiment uses #6004 Citrus in place of d-limonene. The inventors have found that this composition is particularly effective in removing mildew from variety of household surfaces, such as wood, metal, ceramic and plastic without damaging the surfaces. The composition is applied to the surface, usually by spraying, and allowed to react with the mildew. After a few seconds, the mildew is easily removed by rinsing with water. Furthermore, this particular combination has additional advantages in that it can also act simultaneously as a de-greaser, while giving off a pleasant citrus-like odor. Also the effective composition is sufficiently dilute that it can be rinsed off the surface, without doing harm to the immediate environment.

DESCRIPTION OF THE INVENTION

A number of tests, shown in the table below, were performed to demonstrate the efficacy of the claimed range at varying compositions on different surfaces. The indicated percentages were added to a balance of water before application. The mildew type present on each surface was of the type perisporlaceae (dark mildew). Room temperature (69°-71°F.) was maintained during the tests. Elapsed time was measured from application of the composition by spraying until complete removal of the mildew by rinsing with water. All of the tests below resulted in complete removal of the mildew with no damage to the surface.

| Composition | | Surface Type | Time (sec) |
|---|---|---|---|
| NaOCl | 3.95% | Raw wood | 15 |
| $NaHCO_3$ | 0.50% | Vinyl | 10 |
| $C_{10}H_{16}$ | 0.50% | Painted Wood | 10 |
| NaOCl | 3.25% | Raw wood | 120 |
| $NaHCO_3$ | 0.50% | Vinyl | 75 |
| $C_{10}H_{16}$ | 0.20% | Painted Wood | 60 |
| NaOCl | 2.75% | Raw wood | 315 |
| $NaHCO_3$ | 0.10% | Vinyl | 180 |
| $C_{10}H_{16}$ | 0.10% | Painted Wood | 180 |

The inventors have demonstrated that the claimed range is critical. If any of the limits are exceeded, certain necessary effects are lost. As can be seen, the composition with the highest concentration of sodium hypochlorite (NaOCl) is the most effective, resulting in almost instantaneous removal of mildew. However, 4% is the upper limit for this ingredient, as any higher concentration resulted in the splitting of the grain on raw wood samples and damage to a painted or stained wood surface resulting in a matte-like or chalky surface. When the concentration of sodium hypochlorite is brought below about 2.75%, the action becomes exceedingly slow for common mildew, and is totally ineffective on molds and algae.

Sodium bicarbonate ($NaHCO_3$) acts in the composition as a buffer to the sodium hypochlorite and in combination with the d-limonene ($C_{10}H_{16}$) as a surfactant. The concentration of sodium bicarbonate should not exceed about 2%, as this tends to slow the action of the sodium hypochlorite and to reduce the odor masking effect of the d-limonene. If the sodium bicarbonate concentration is below about 0.5%, its buffering action is reduced and the unchecked sodium hypochlorite begins to damage the surface, for example by bleaching a raw, painted or stained wood surface. Thus, the sodium bicarbonate concentration should be increased or decreased accordingly with the concentration of the hypochlorite to maintain proper buffering action. Another result of a concentration below 0.5% is that the de-greasing action fails to occur. It is thus apparent that a certain threshold amount of bicarbonate is needed to act in concert with the d-limonene, so as to bubble away the grease which is acted upon by the d-limonene.

As stated above, d-limonene acts as both a de-greasing agent and as an odor masking agent, which covers up the unpleasant hypochlorite odor with a pleasant citrus-like aroma. The concentration of d-limonene should be kept at above about 0.5% to obtain these properties. While the best composition for achieving these properties uses a d-limonene concentration of about 2%, the lower limit may be approached as a matter of economy. However, as the 0.5% lower limit is approached, the sodium bicarbonate concentration should also be lowered to below 1.0% to maintain the effectiveness of the d-limonene. The upper limit of d-limonene should not exceed 5%, so as to avoid a slick residue being left on wood surfaces, or a sticky residue being left on plastic or vinyl.

As is demonstrated, in order to obtain the most effective compositions, the concentrations of the ingredients must be balanced against each other within the range to retain the full advantage of the invention. The most effective balance is obtained by providing a composition comprising an aqueous solution of, by weight, about 2.75–4% sodium hypochlorite, about 0.5–2% sodium bicarbonate and about 0.5–5% d-limonene. A more preferred composition comprises about 3.25–4% sodium hypochlorite, about 0.5–1% sodium bicarbonate and about 0.5% d-limonene, with the most preferred composition comprising about 3.95% sodium hypochlorite, about 0.5% sodium bicarbonate and about 0.5% d-limonene. Although one particular advantage of the composition is that it can be safely used on a variety of surfaces, a composition within the range may be prepared for especially treating a particular surface.

Though the tests in the table were all performed at room temperature, the composition is effective generally at temperatures greater than 50° F. Also, the effectiveness of the composition against microorganisms should not be limited to the particular mildew claimed. Additional testing was done to confirm that the composition is effective against the Downey mildew family, as well as molds and algae in general. Further, it has been found that the claimed composition is extremely effective in removing grease.

It is also been demonstrated that International Flavors and Fragrances #6004-HT Citrus may be substituted for d-limonene. Tests showed that this compound provides a masking odor at 0.5%, but becomes too strong at over 1.0%. The de-greasing ability of #6004-HT Citrus was found to be about one-half that of d-limonene on a comparative weight basis. It is contemplated that #6004-HT Citrus would be useful in a formulation specifically for plastic surfaces, as it is more compatible with this surface than is d-limonene.

Though the claimed invention has been described herein, the applicants contemplate that minor variations may be made without departing from the scope of the claimed invention.

What is claimed is:

1. A composition for removing mildew from a surface, consisting essentially of an aqueous solution of, in weight percent, about 3.25–4% sodium hypochlorite, about 0.5–1% sodium bicarbonate and about 0.5–1% d-limonene.

2. The composition of claim 1, wherein the concentration of sodium hypochlorite is about 3.95%, the concentration of sodium bicarbonate is about 0.5% and the concentration of d-limonene is about 0.5%.

3. A method for removing mildew from a surface, comprising the steps of:

(a) applying to a surface a composition consisting essentially of an aqueous solution of, in weight percent, about 3.25–4% sodium hypochlorite, about 0.5–1% sodium bicarbonate and about 0.5–1% d-limonene, and (b) rinsing the surface with water.

4. The method of claim 3, further comprising the step of, between steps (a) and (b), allowing the composition to remain in contact with the surface for a time sufficient to effect removal of the mildew without damaging the surface.

* * * * *

UNITED STATES PATENT AND TRADEMARK OFFICE

CERTIFICATE OF CORRECTION

PATENT NO. : 5,281,280

DATED : January 25, 1994

INVENTOR(S) : Michael J. Lisowski and Ronald D. Jones

It is certified that error appears in the above-identified patent and that said Letters Patent is hereby corrected as shown below:

Column 2, lines 30-40, the table should appears as follows, so that a space is properly indicated between each composition:

| Composition | | Surface Type | Time (sec) |
|---|---|---|---|
| NaOCl | 3.95% | Raw wood | 15 |
| $NaHCO_3$ | 0.50% | Vinyl | 10 |
| $C_{10}H_{16}$ | 0.50% | Painted Wood | 10 |
| NaOCl | 3.25% | Raw wood | 120 |
| $NaHCO_3$ | 0.50% | Vinyl | 75 |
| $C_{10}H_{16}$ | 0.20% | Painted Wood | 60 |
| NaOCl | 2.75% | Raw wood | 315 |
| $NaHCO_3$ | 0.10% | Vinyl | 180 |
| $C_{10}H_{16}$ | 0.10% | Painted Wood | 180 |

Signed and Sealed this

Thirty-first Day of May, 1994

Bruce Lehman

*Attest:*

BRUCE LEHMAN

*Attesting Officer*

*Commissioner of Patents and Trademarks*